US005479672A

United States Patent [19]

Brown et al.

[11] Patent Number: 5,479,672

[45] Date of Patent: Jan. 2, 1996

[54] FLOOR CLEANING AND POLISHING EQUIPMENT

[75] Inventors: Dennis J. Brown, High Wycombe; Roger J. M. Simpson, Slough, both of United Kingdom

[73] Assignee: Lever Industrial Company, Division of Indopco, Inc., Bridgewater, N.J.

[21] Appl. No.: 280,698

[22] Filed: Jul. 26, 1994

[30] Foreign Application Priority Data

Jul. 26, 1993 [GB] United Kingdom ..... 9315447

[51] Int. Cl.[6] ..... A47L 11/14

[52] U.S. Cl. ..... 15/98; 15/49.1; 451/353

[58] Field of Search ..... 15/49.1, 50.1, 15/98, 385; 451/353, 359; 299/41

[56] References Cited

U.S. PATENT DOCUMENTS 4,099,328 7/1978 Schlemmer ..... 15/49.1

4,590,713 5/1986 Yasui ..... 15/49.1

*Primary Examiner*—Edward L. Roberts, Jr.

*Attorney, Agent, or Firm*—A. Kate Huffman

[57] ABSTRACT

A combined floor cleaning and floor polishing machine comprises a motor housing (1), an inclined operator handle (2), a base (3) with castors (4) and a motor-operated shaft (5) for a rotating disc (7) supporting interchangeably a cleaning pad or polishing pad, so that the machine weight is carried partly on the pad and partly on the castors (4). If the handle (2) is tilted the machine moves laterally to one side or other in dependence upon the direction of tilt. The use of elastomeric torsion blocks (8) to connect the motor housing (1) to the base (3) provides an elastic resistive force in either tilt direction and thus improves controllability of the cleaning/polishing movement in either lateral direction, by a simple, robust and inexpensive construction.

4 Claims, 1 Drawing Sheet

FLOOR CLEANING AND POLISHING EQUIPMENT

FIELD OF THE INVENTION

This invention relates to a combined mechanical floor cleaner and floor polisher.

BACKGROUND OF THE INVENTION

Mechanical floor cleaners or floor polishers typically possess a circular pad driven to rotate about a vertical axis by an electric motor mounted on a frame or housing located above the pad, and an upwardly angled operating handle extending from the frame or housing generally upwards to a suitable height for use.

Such cleaners or polishers can be readily caused to move to or fro transversely by the operator. This is done by lifting or lowering the handle, so as to tilt the pad and cause either the front half or the rear half of the pad to engage relatively more strongly with the floor and thus give the pad a useful sideways component of motion. By judicious tilting motion of the handle the operator can move slowly forwards or backwards and effectively clean or polish a wide track of the floor to either side of his personal movement.

Historically, there have been problems in providing a single machine for both cleaning and polishing purposes. It is not difficult to design suitable pads and adapt them for selective interchange, but the weight of the original machines was such that while the optimum speed of the motor, or a suitable ratio could be used for polishing, the more robust action of cleaning would generate enough friction to stall the motor or to give undesirable wear, noise, and heat problems.

European Patent 0122181 shows an earlier solution to this problem. In this patent, the weight of the equipment is largely carried by the two rear castor wheels, but the weight of the pad and motor is generally supported on a separate sub-frame tiltable about a transverse axis in relation to the remainder of the equipment by virtue of a linkage adjustably attached to a suitable part of the handle. Thus, when the handle is raised or lowered the sub-frame is tilted accordingly and the pad is tilted so that the equipment moves transversely as required. Because the total weight is split between the castors and the pad, high speeds suitable for dry scrubbing/polishing can also be used (with a changed pad) for cleaning purposes.

Although such equipment is valuable for the purpose stated, provision of a mechanical linkage adds to cost and complexity, as does the need to adjust the link connection for each different user so as to give a comfortable working height. Moreover, the link movement has regions of insensitivity, giving a less controlled or lunging sideways movement, especially when wear has taken place at the joints. The handle, wherever adjusted for use, droops downward under its own weight when not in use, and has therefore to be positively held up at the preferred height by the user.

A more recent proposal is to attach the handle directly to the motor housing and then to mount this housing on a axis tiltable in smoothly operating bearings, one to each side, journalled to the main frame of the machine. The main portion of the machine is supported on the two rear castors and one forward, height-adjustable, castor.

Raising or lowering the handle again gives the necessary tilt to the pad to promote side to side cleaning or polishing movement.

The handle in this known device is supported against falling downwards by compression springs providing support for the motor housing, such springs being located one to each side behind the smoothly operating bearings and forward of the point of attachment of the handle.

While this device is simpler in construction than the earlier device described in European Patent 0122181, it still has the disadvantage that the compression springs will allow the handle to droop beneath any given adjusted user optimum position, that is to say a position where for a given user the pad is horizontal. Also, the upward movement, leading to forward tilt of the pad, appears to act only against gravity so that there are two different types of forces to overcome depending upon whether the handle is raised or lowered. This again leads to a tendency to lunging or swooping movement in sideways travel.

SUMMARY OF THE INVENTION

The present invention sets out to overcome the above problems by providing a tiltable mounting with uniform control capability for movement in either tilting direction.

BRIEF DESCRIPTION OF THE DRAWINGS

The invention will be further described with reference to the accompanying drawings, in which.

DETAILED DESCRIPTION OF PREFERRED EMBODIMENTS

One aspect of the invention is a combined floor cleaning and floor polishing machine of the type possessing a base with floor engaging castors; a rearwardly and upwardly extending handle; and a motor means attached to the handle and mounted on the base and including a vertical or substantially vertical downwardly extending rotary shaft to drive a selectively changeable pad, whereby the weight of the machine is distributed in use between the castors and the pad:

characterised in that the motor means is mounted on the base by one or more elements to permit controllable tilting of the motor means and its attached pad in either direction against an elastic resistive force.

The mounting element or elements is or are therefore to be distinguished from such elements in the prior art proposals, whether these proposals involve a link tilting a sub-frame, or a pivoted motor housing and a handle supported on compression springs. In both of these prior art proposals the mounting is essentially rigid. In the latter moreover, the handle support spring is only used in compression, whereby the force resistive to moving the handle is essentially acting against gravity in one-direction but progressively spring-resisted in the other.

The mounting element(s) in the practice of this invention may be made of elastomer or metal, provided that it or they manifest for either direction of tilt an elastic resistive force.

Thus, the mounting element or elements may operate by virtue of a compression or extension resistance; for example, they may be a single block or layer of elastomer, e.g. natural rubber, completely or partly filling any gap between the motor means and the base, or may be a spaced pair or plurality of compression/extension support blocks.

More preferably the motor means ms mounted upon the base by means of elastomeric elements which respond elastically in torsion.

Such elements can be a pair of flat metal springs in spiral or part-spiral form, fixed betweeen the motor means and the base, (one fixed at the extremity and one at the centre) with central axes aligned to either side. More typically they are elastomeric elements.

Such elements may more preferably be in the form of elastomeric blocks generally aligned to either side of the motor means. More especially, there is envisaged the use of two flat cylindrical blocks, with axes aligned, located one to either side of the motor means. Such flat cylindrical blocks of elastomeric material can be sandwiched between metal plates for ease of attachment and use.

Figure 1:
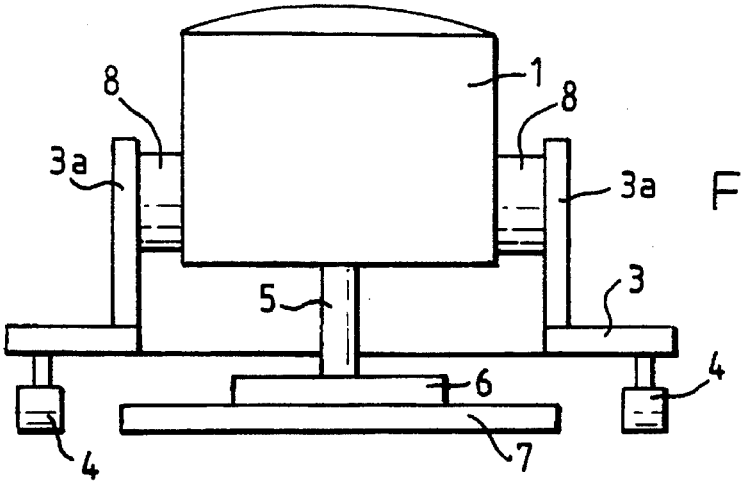
FIG. 1 is a diagrammatic front view of a combined floor cleaner and floor polisher.
Figure 2:
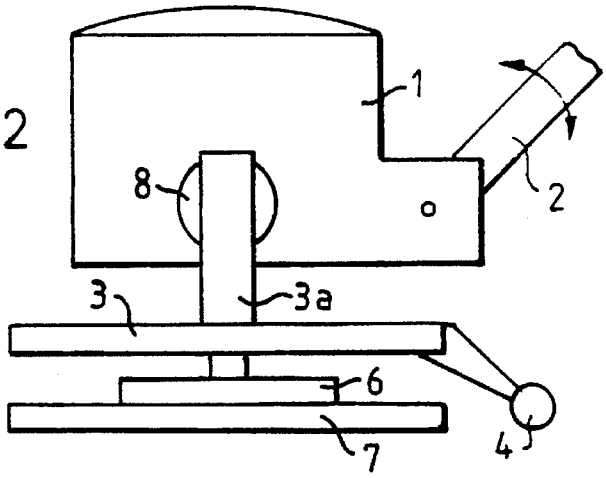
FIG. 2 is a diagrammatic side view of such a cleaner/polisher according to the invention.

The cleaner/polisher shown in FIGS. 1 and 2 comprises a motor housing 1, a control handle 2 extending upwardly and rearwardly from the housing upon which it is fixed, a base 3 with lateral castors 4 at a rearward location thereof, and a rotary shaft 5 operated by the motor (not shown) within housing 1. The shaft 5 is attached by a rigid or flexible coupling 6 to a rotary disc 7 to accommodate a removable pad chosen for the particular cleaning or polishing function, not separately shown.

The base 3 has two opposed upwardly extending members 3*a* which are fastened to respective opposite sides of the motor housing by the intermediary of respective cylindrical elastomeric coupling blocks 8.

These blocks are not bearings. They do not possess an unequivocal centre line acting as a pivot. They are cylindrical for convenience, but could be of other shapes. Typically, they are made of vulcanized natural rubber.

Figure 3:
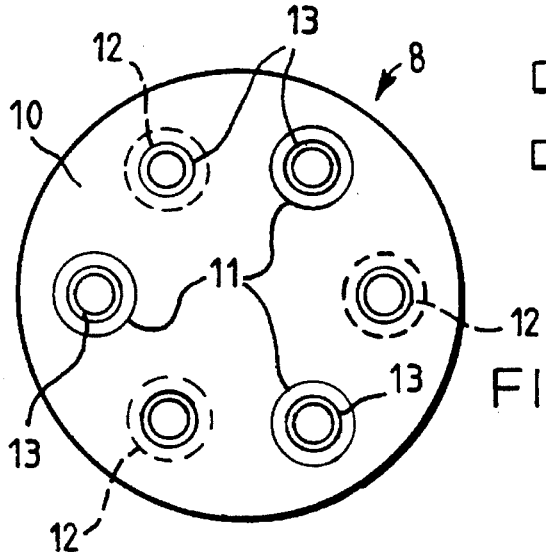
FIG. 3 is an enlarged view of one embodiment of vulcanized rubber coupling element from one side of the machine.
Figure 4:
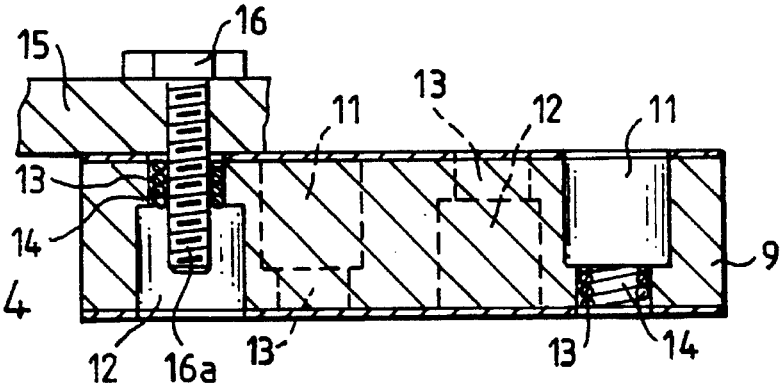
FIG. 4 is a cross sectional view through the coupling element of FIG. 3.

A convenient configuration of such a block 8 is shown in FIGS. 3 and 4. This shows the rubber cylinder 9 faced at each flat end with circular steel plates 10, to facilitate attachment. A convenient means of attachment is as shown, comprising six stepped holes 11, 12 oriented alternately in opposite directions but otherwise identical; however, other designs, e.g. utilizing four such holes, are also possible. Within each hole 11 or 12 is a bonded metal insert in the form of a sleeve 13 internally threaded at 14, whereby a portion 15 of the base or motor means as the case may be can be bolted on by bolt 16, the end 16*a* of which locates conveniently within the larger portion of stepped hole 11 or 12.

The cleaner/polisher as shown is designed to split the overall floor weight between the castors 4 and the operative pad on disc 7. The control handle can be used as conventional with such machines, by up and down movement as well as general forward movement. The up and down movement puts the rubber blocks 8 in torsion, but they can move enough to allow the pad to tilt and consequently produce a transverse movement as desired.

It is particularly valuable that there is minimum resistive force of the same general nature against either downward movement or upward movement of the handle, in contrast with the prior proposed arrangement where downward movement about bearings is resisted by compression springs while upward movement is either spring-assisted or against gravity, i.e. not against an equivalent spring. In practice this similarity of resistive force gives a much more controllable machine which does not swoop or lunge in its sideways movements.

For convenience of illustration no user-adjustment mechanism for the control handle is shown. This can however be readily incorporated at the end of the handle by a gear and gear plunger.

In addition to the facility of using non-cylindrical blocks, in a location generally as shown and operating with torsional resistance, it is possible to incorporate other types of elastomeric block between base 3 and motor housing 1. For instance peripheral support blocks, or a single such block between the housing 1 and base 3 could be used, the resistive force being compressive or extensive rather than torsional. Alternatively, spiral torsion springs could be utilised.

The elastomeric mounting system between the base 3 and housing 1 gives the machine further advantages of comfort of handling and low noise generation. Moreover, because no bearing with a fixed centreline is present, the manipulative possibility presents itself of twisting the handle, to push one side or other of the motor housing downwards, and thus give an imparted to-and-fro longitudinal movement, useful for elongate spaces such as walkways or corridors.

The use of rubber components, in torsion or otherwise, between the base and the motor housing should not be confused with the known expedient of connecting the motor shaft to the disc or its pad by a flexible elastomeric connector. This latter expedient copes with minor irregularities or small changes of surface characteristics, whereas the present invention is concerned with a mounting of the motor in relation to the base to achieve good multi-directional control and other advantages.

We claim:

1. A combined floor cleaning and floor polishing machine comprising:

(i) a motor housing;

(ii) a base having two opposed upwardly extending members means attaching the base to the motor housing;

(iii) floor engaging castors attached to said base;

(iv) a rearwardly and upwardly extending control handle attached to the motor housing; and (v) motor means mounted in said motor having, said motor means comprising a substantially verticle downwardly extending rotary shaft means for driving a rotary disc attached to the shaft by a coupling the rotary disc having a selectively changeable pad, and the operative floor weight of said motor means being split between the operative pad on the rotary disc and the castors, wherein the means attaching the motor housing to said base comprises two elastomeric blocks aligned one to either side of the motor means, said elements being fastened between the members of the base and the motor housing to provide for relative movement therebetween.

2. A machine according to claim 1 wherein the blocks are flat cylindrical blocks.

3. A machine according to claim 2, wherein the cylindrical blocks are sandwiched between metal plates.

4. A machine according to claim 3, wherein the blocks comprise at least four stepped holes oriented alternately in opposite directions but otherwise substantially identical, said holes comprising a metal sleeve with threads means for allowing the base member and the motor housing to be bolted to said blocks by bolts.

* * * * *